US006162102A

United States Patent [19]

Choy

[11] Patent Number: 6,162,102

[45] Date of Patent: Dec. 19, 2000

[54] CONTACT ARRANGEMENT FOR USE WITH HIGH SPEED TRANSMISSION

[75] Inventor: Edmond Choy, Union City, Calif.

[73] Assignee: Hon Hai Precision Ind. Co., Ltd., Taipei Hsien, Taiwan

[21] Appl. No.: 09/273,923

[22] Filed: Mar. 22, 1999

[51] Int. Cl.[7] ..... H01R 13/40

[52] U.S. Cl. ..... 439/752.5; 439/751

[58] Field of Search ..... 439/752.5, 751, 439/744, 733.1, 869, 870, 871

[56] References Cited

U.S. PATENT DOCUMENTS

| | | | |
|---|---|---|---|
| 4,317,609 | 3/1982 | Lapraik | 439/752.5 |
| 4,354,729 | 10/1982 | Grabbe et al. | 439/733.1 |
| 4,439,001 | 3/1984 | Curley et al. | 439/733.1 |
| 4,491,382 | 1/1985 | Ishikawa | 439/733.1 |
| 4,946,403 | 8/1990 | Billman et al. | 439/733.1 |
| 5,277,621 | 1/1994 | Seto | 439/733.1 |
| 5,882,230 | 3/1999 | Bricaud et al. | 439/733.1 |
| 5,951,335 | 9/1999 | Kurotori et al. | 439/733.1 |

*Primary Examiner*—Paula Bradley
*Assistant Examiner*—Katrina Davis
*Attorney, Agent, or Firm*—Wei Te Chung

[57] ABSTRACT

A card edge connector (10) includes an elongated housing (12) defining a central slot (14) for receiving the corresponding card therein and a plurality of passageways (16) by two sides of the central slot (14). A plurality of contacts (22) are received within the corresponding passageways (16), respectively. Each of the contacts (24) includes a horizontal base (26), from which two beams (27, 28) respectively extend upwardly therefrom for mutually cooperative transmitting high speed signals, and a third beam (32) extends upward proximate the outermost end (34) of the base (26) for guidance and retention of the contact (24) with regard to the housing (12). A retention section (42) is positioned at the innermost end (43) of the base (26). Correspondingly, an retention wall (20) is formed within each passageway (16) for guidable and interferential engagement with the third beam (32) of the corresponding contact (24) in the passageway (16).

7 Claims, 5 Drawing Sheets

CONTACT ARRANGEMENT FOR USE WITH HIGH SPEED TRANSMISSION

BACKGROUND OF THE INVENTION

1. Field of The Invention

The invention relates to a card edge connector, and particularly to contact arrangement thereof so as to meet the requirements of high speed transmission.

2. The Related Art

The copending application Ser. No. 09/149,884 filed Sep. 8, 1998, discloses contact arrangement within a card edge connector which may meet electrical and mechanical high speed transmission requirements.

Anyway, there are still some flaws in such a design. First, there is no sufficient retention mechanism between the contact and the housing to securely fix the contact with regard to the housing in position without possible rotation disadvantage, when a force is imposed upon the contact. Secondly, when the contact is insertably installed into the housing, there is no proper guidance and restriction means for precisely guiding the inserted contact to reach its final true position without possible tilting disadvantage.

Therefore, an object of the invention is to provide a card edge connector which has contacts therein to meet the high speed transmission requirements wherein the contacts can be precisely and efficiently guidably inserted into the corresponding passageway in the housing and retained in position without tilting and unstable disadvantages.

SUMMARY OF THE INVENTION

According to an aspect of the invention, a card edge connector includes an elongated housing defining a central slot for receiving the corresponding card therein and a plurality of passageways by two sides of the central slot. A plurality of contacts are received within the corresponding passageways, respectively. Each of the contacts includes a horizontal base, from which two beams individually extend upwardly therefrom for mutually cooperative transmitting high speed signals, and a third beam extends upward proximate one end of the base for guidance and retention of the contact within housing. An retention section is positioned at the other opposite end of the base. Correspondingly, an retention wall is formed within each passageway for engagement with the third beam of the corresponding contact in the passageway.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
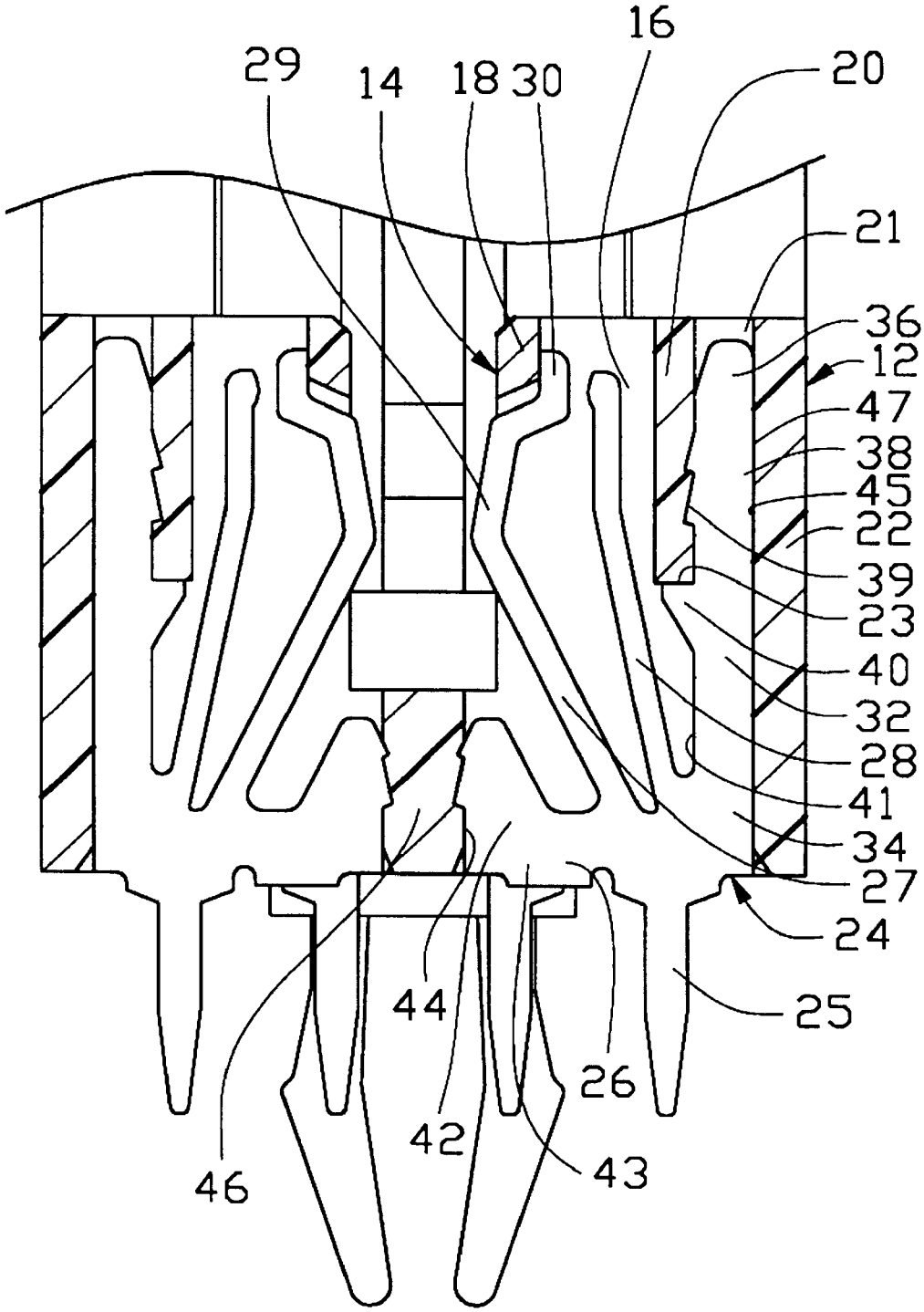
FIG. 1 is a cross-sectional view of a presently preferred embodiment of a high speed card edge connector with contacts fully inserted thereinto, according to the invention.
Figure 2:
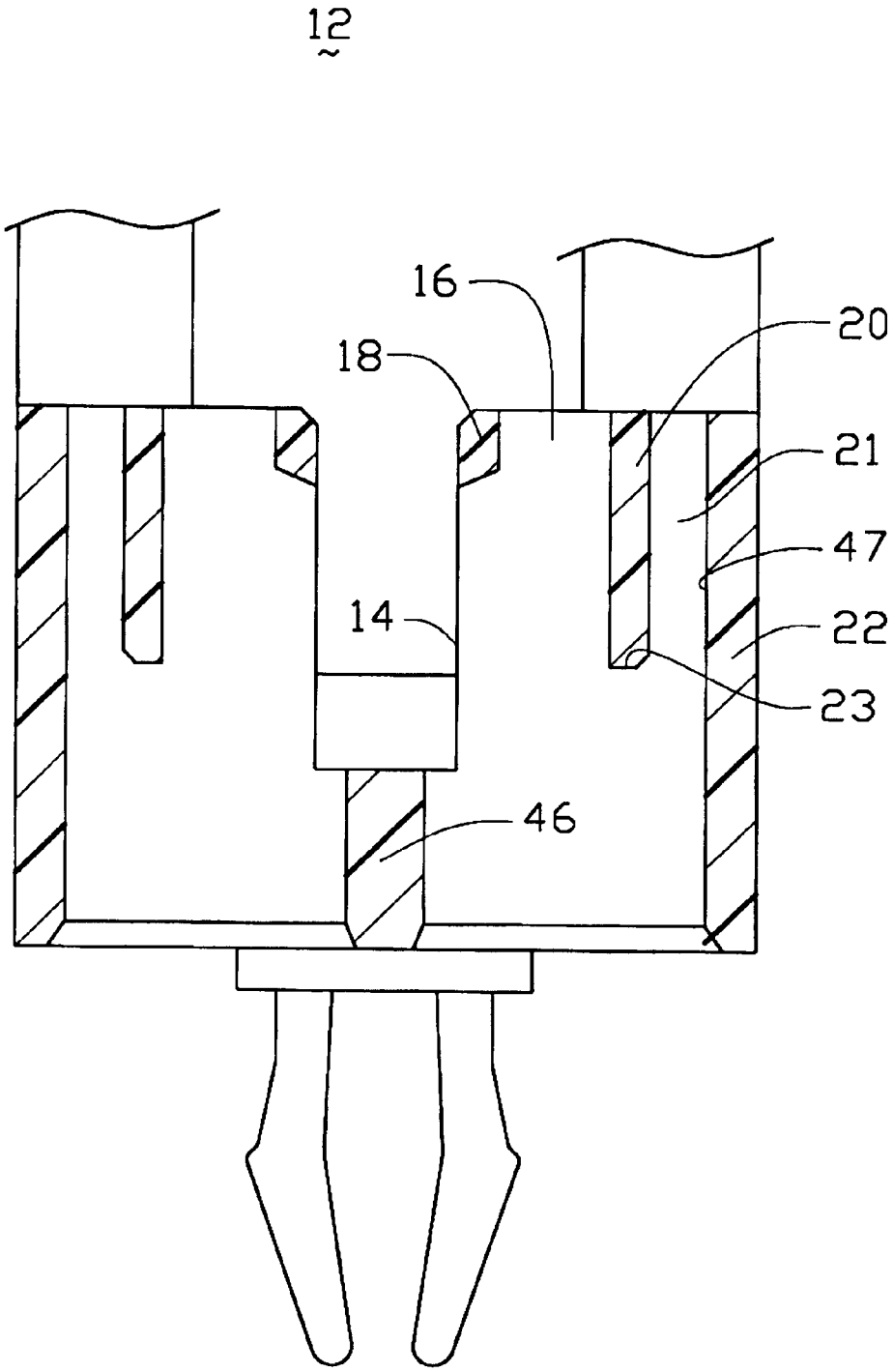
FIG. 2 is a cross-sectional view of the housing of the connector of FIG. 1.
Figure 3:
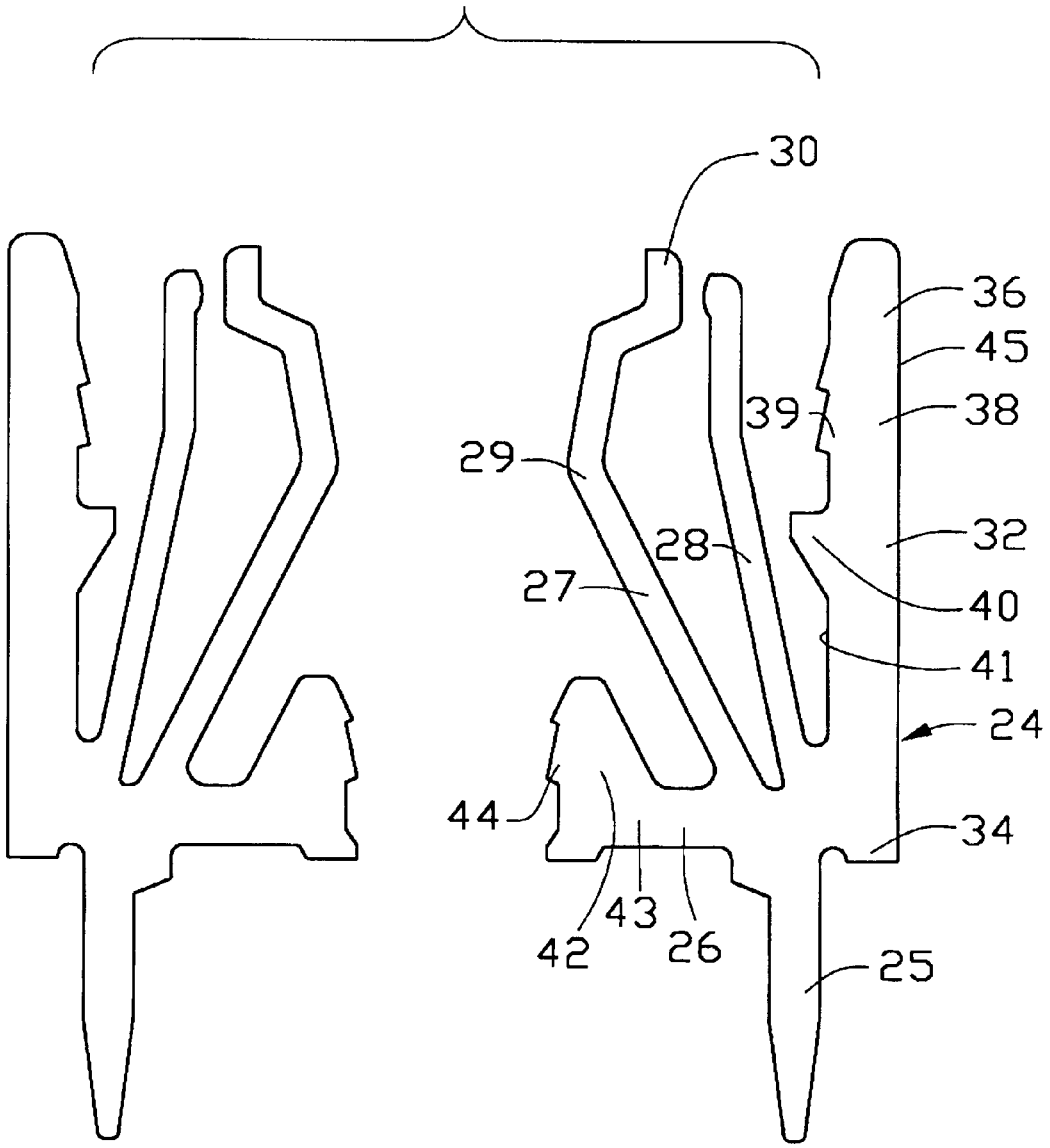
FIG. 3 is a plan view of a pair of contacts adapted to oppositely disposed within the corresponding pair of opposite passageways in the same cross-sectional plane as shown in FIG. 2.

It will be noted here that for a better understanding, most of like components are designated by like reference numerals throughout the various figures in the embodiments. Attention is directed to FIGS. 1–3 wherein a high speed card edge connector 10 includes an insulative housing 12 defining a central slot 14 for receiving a card (not shown) therein. A plurality of passageways 16 are disposed by two sides of the central slot 14 in the housing 12. Each passageway 16 forms, on the upper portion, an abutment block 18 close to the central slot 14, and a retention wall 20 close to the side wall 22 thereby forming a channel 21 therebetween.

A contact 24 is adapted to be inserted into each of the passageways 16, and includes a horizontal base 26 from which a leg 25 downwardly extends and first and second resilient contact beams 27, 28 individually upward extending for mutually cooperatively transmitting high speed signals therethrough. The first beam 27 defines an apex 29 extending into the central slot 14 for engagement with the corresponding circuit pads on the inserted card (not shown) wherein the operation manner of the first and second resilient contact beams 27 and 28 with the inserted card can be referred to the aforementioned copending application Ser. No. 09/149,884, and a distal end 30 for engagement with the abutment block 18 for preloading consideration. Under this situation, when the card is inserted into the central slot 14 of the connector 10 and engaged with the apex 29 of the first beam 27, the first beam 27 will be deflected outward toward the second beam 28. Successively, the distal end 30 of the first beam 27 will engage the distal end of the second beam and actuate the second beam 28 to outwardly move commonly, thus creating mutually cooperatively mechanical and electrical transmission between the first beam 27 and the second beam 28.

A third rigid guidance beam 32 upward extends from an outermost end 34 of the base 26 in a distance in compliance with the height of the side wall 22. The third beam 32 includes a retention region 36 on the upper portion 38 thereof with barbs 39 on the inner side 41 facing to the central slot 14 for engagement with the corresponding retention wall 20 in an interference fit. A stopper shoulder 40 is formed on a middle of the third beam 32 for abutting against the bottom end 23 of the retention wall 20. A retention section 42 is formed at the innermost end 43 of the base 26 with barbs 44 facing to the central slot 14 for interferential engagement with the central rib 46 of the housing 12 under the central slot 14.

Under this condition, the contact 24 can be insertably installed into the corresponding passageway 16 from the bottom. The tip of the third beam 32 may first confront the retention wall 20 and move along the channel 21 for efficiently and precisely guiding further insertion of the contact 24 within the passageway 16. This upward insertion of the contact 24 will continue until the stopper shoulder 40 abuts against the bottom end 23 of the retention wall 20. Under this situation, the barbs 39 on the inner side 41 of the third beam 32 and barbs 44 on the retention section 42 can be respectively interferentially engaged with the retention wall 20 and the central rib 46 for efficiently retaining the contact 24 in position within the passageway 16 of the housing 12, and the tip of the first beam 27 may abut against the abutment block 18 for preloading consideration.

Figure 4A:
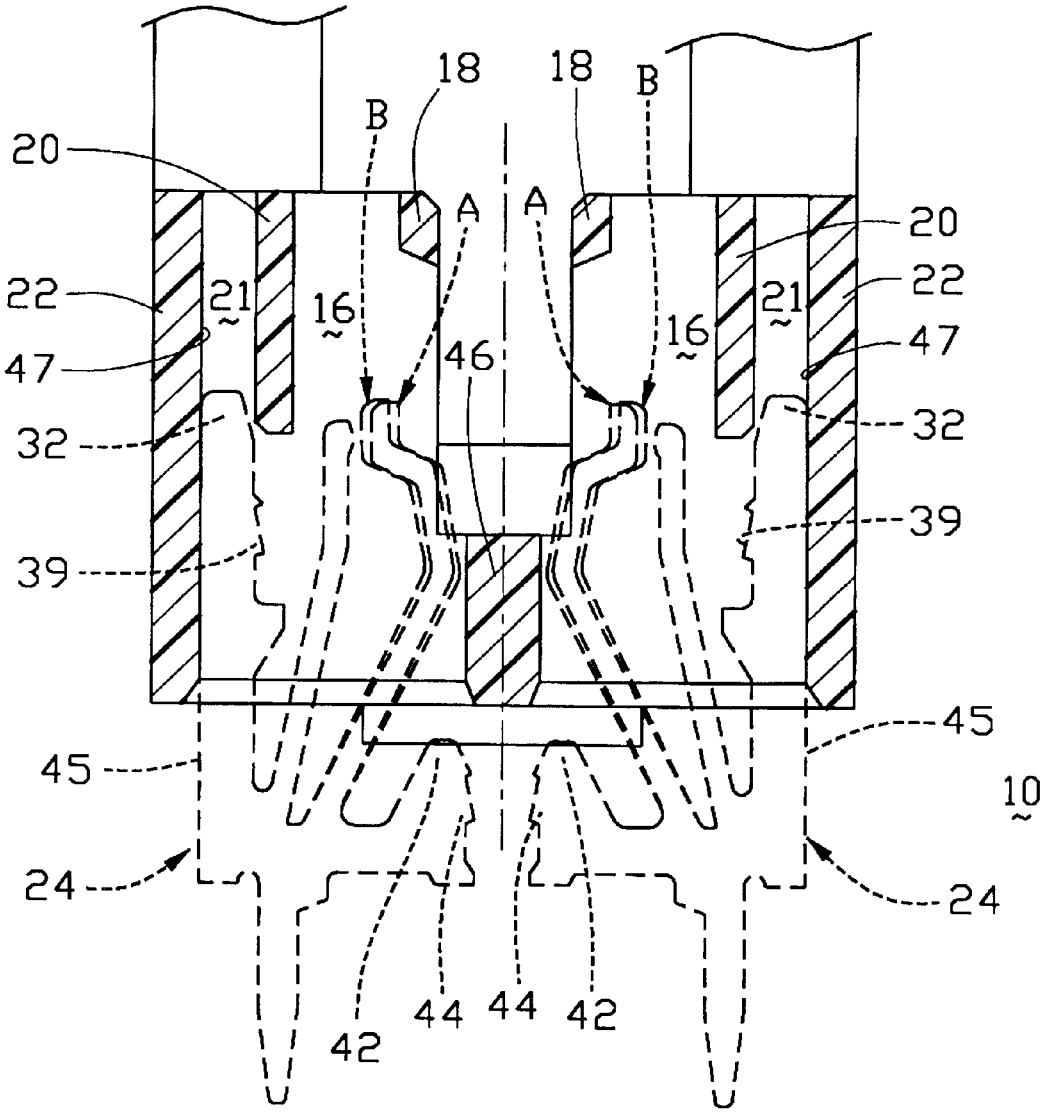
FIG. 4(A) is a cross-sectional view of the connector of FIG. 1 to show when the contact is initially inserted into the corresponding passageway, first the third beam confronts the retention wall for guiding.
Figure 4B:
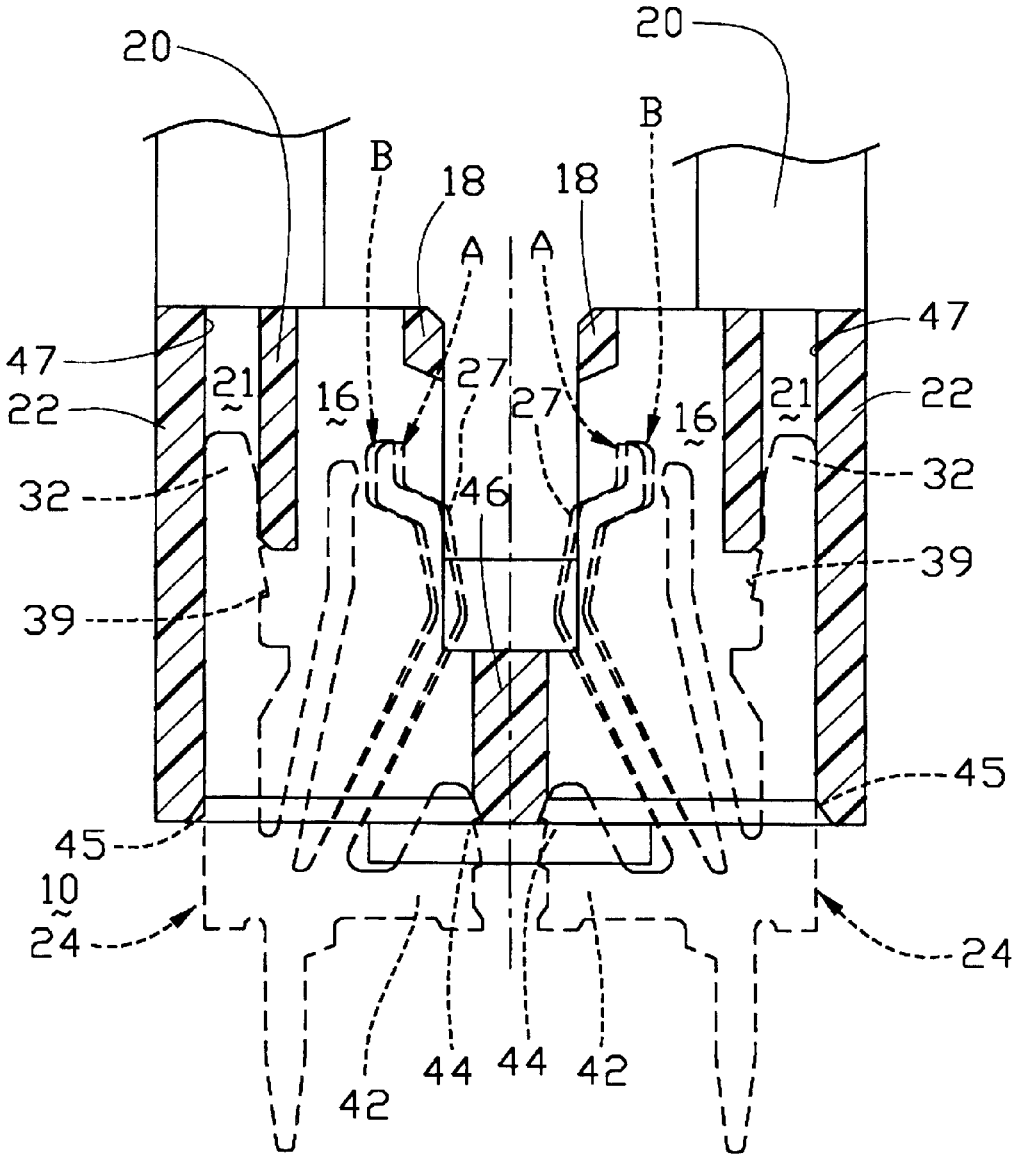
FIG. 4(B) is a cross-sectional view of the connector of FIG. 1 to show the retention section later joins engagement between the contact and the housing during assembling for finalizing the true position of the contact within the housing in an interference it.

It should be appreciated that referring to FIGS. 4(A) and 4(B), when the contact 24 is inserted into the passageway 16, only the third beam 32 is first engaged with the housing 12, i.e., the side wall 22 and/or the retention wall 20, and is guidably moved along the channel 21 to have the whole contact 24 correctly upward move within the passageway 16 without tilting. It should be noted that the outer side 45 of the third beam 32 is smooth without barbs thereon so as to smoothly slidably move along the inner surface 47 of the side wall 22 for a distance. Then, the retention section 42 joins for aligning further insertion and final retention of the contact 24 to obtain the true position of the contact 24 in the passageway 16. Because the barbs 39 on the third beam 32 and the barbs 44 on the retention section 42 are all directed toward the central slot 14, thus resulting in outward moving of the contact 24 toward the corresponding side wall 22 and substantially abutting thereagainst, and having the third beam 32 tightly sandwiched between the retention wall 20 and the side wall 22, and having the retention section 42 of the contact 24 tightly interferentially engaged within the central rib 46, respectively. Therefore, the contact 24 can be reliably and correctly inserted into and retained within the corresponding passageway 16 of the housing 12. It is also noted that because of the retention wall. 20 and the elongated third beam 32 with almost the same length as the height of the side wall 20 of the housing 12, and the stopper shoulder 40 thereof, the contact 24 may be securely retained within the passageway 16 without tilting when the force is imposed thereunto by the inserted card.

It should be noted that the first beam 27 generally is in a relaxed normal state as shown in FIG. 3 and in position A in FIGS. 4(A) and 4(B), while during insertion of the contact 24 into the housing 12, will be deflected outward to be in position B of FIGS. 4(A) and 4(B) by a tool which is temporality and removeably installed within the central slot 14 of the housing 12 for helping the first beam 27 be preloaded against the block 18, thus resulting in the final assembly as shown in FIG. 1.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

I claim:

1. A card edge connector for use with a card adapted to be inserted thereinto, comprising;

an insulative housing defining a central slot with two rows of passageways by two sides of the central slot;

a plurality of contacts respectively received within corresponding passageways; and each of said contacts including a horizontal base, a first and second resilient contact beam respectively extending upwardly from the horizontal base and located on a same side of the central slot for cooperatively transmitting signals, the first resilient contact bean having an apex extending into the central slot for engagement with the inserted card, a third guidance beam upwardly extending from the horizontal base proximate an outermost end thereof for guidably precise insertion of the contact into the passageway;

a retention wall is formed in an upper portion of each of said passageways and is spaced from a side wall by said passageway for guidable and interferential engagement with the third guidance beam, a retention section is formed on the base proximate an innermost end thereof opposite to the third guidance beam and the third guidance beam has barbs on an inner side facing toward the central slot and has a smooth surface on an outer side facing toward a side wall of said passageway.

2. The connector as defined in claim 1, wherein the third guidance beam includes a stopper shoulder abutting against a bottom end of the retention wall.

3. A card edge connector for use with a card, comprising:

an insulative housing defining a central slot with a plurality of passageways by two sides of said central slot;

a plurality of contacts retainably received within corresponding passageways, respectively;

each of said contacts including a base from which at least one resilient contact beam extends upwardly with an apex protruding into the central slot for engagement with the inserted card;

another guidance beam extending upward from the base proximate an outermost end thereof with a length in compliance with a height of a side wall beside said corresponding passageway wherein said passageway further includes therein a retention wall spaced from said side wall for engagement with said guidance beam; and a retention section extending from the base proximate an innermost end thereof and opposite to said guidance beam for engagement with a central rib under the central slot; wherein means for retention is provided respectively on same sides of the guidance beam and said retention section, commonly facing the central slot, and the other side of the guidance beam is smooth for slidably moving along an inner surface of the side wall such that the contact may be pushed toward the side wall during insertion of the contact for tight retention within the passageway.

4. A card edge connector for use with a card, comprising:

an insulative housing defining a central slot and a plurality of passageways by two sides of said central slot;

a plurality of contacts received within corresponding passageways, respectively;

each of said contacts including a base from which at least one resilient contact beam extends upwardly with an apex protruding into the central slot for engagement with the card inserted into the central slot;

a guidance beam extending from one end of the base for engagement with a retention wall, said retention wall being formed in an upper portion of the corresponding passageway and spaced from a side wall beside said passageway, a channel being defined between the retention wall and the side wall for receiving said guidance beam; and a retention section extending upwardly from the other end of the base opposite to said guidance beam; wherein the guidance beam is longer than the retention section so that when the contact is inserted into the corresponding passageway from a bottom portion of the housing, the guidance beam may first confront the retention wall and guidably slide along the channel to precisely guide upward insertion movement of the contact within the passageway for a distance, and then the retention section joins to engage the housing for further aligning upward movement of the contact within the passageway and retaining the contact in its final position.

5. The connector as defined in claim 4, wherein a stopper shoulder is formed on the guidance beam for abutting against a bottom end of the retention wall.

6. A contact for use with a high speed card edge connector, comprising:

a horizontal base defining a first end and a second end;

a first and a second resilient contact beam respectively extending upwardly from the base;

a third rigid guidance beam extending upwardly from the second end of the base opposite to the third guidance beam; wherein the first and second resilient contact beams extend from a position n the base between the third rigid guidance beam and fourth retention section and both of the third rigid guidance beam and the fourth retention section, and both of the third rigid guidance beam and the fourth retention section have barbs formed thereon facing a same direction, the barbs of the third rigid guidance beam are provided on an inner side thereof and the second resilient contact beam and the third rigid guidance beam are generally of a similar height for slidably moving along an inner surface of a side wall of the connector such that the contact may be pushed toward the side wall during insertion of the contact for tight retention.

7. The contact as defined in claim 6, wherein a stopper shoulder is formed on a middle portion of the third rigid guidance beam.

* * * * *